US005217511A

United States Patent [19]

Plaks et al.

[11] Patent Number: 5,217,511

[45] Date of Patent: Jun. 8, 1993

[54] ENHANCEMENT OF ELECTROSTATIC PRECIPITATION WITH ELECTROSTATICALLY AUGMENTED FABRIC FILTRATION

[75] Inventors: Norman Plaks, Raleigh; Charles B. Sedman, Hillsborough, both of N.C.

[73] Assignee: The United States of America as represented by the Administrator of the Environmental Protection Agency, Washington, D.C.

[21] Appl. No.: 826,302

[22] Filed: Jan. 24, 1992

[51] Int. Cl.[5] ..... B03C 3/14

[52] U.S. Cl. ..... 55/124; 55/334; 55/341.1

[58] Field of Search ..... 55/6, 124, 341.1, 334, 55/335, 302, 418, 419, 126, 128, 129, 131, 133, 151

[56] References Cited

U.S. PATENT DOCUMENTS

| | | | |
|---|---|---|---|
| 1,407,311 | 2/1922 | Witte | 55/124 |
| 3,910,779 | 10/1975 | Penney | 55/124 |
| 3,915,676 | 10/1975 | Reed et al. | 55/112 |
| 3,945,813 | 3/1976 | Ilnaya et al. | 55/108 |
| 4,029,482 | 6/1977 | Postma et al. | 55/2 |
| 4,209,306 | 6/1980 | Feldman et al. | 55/139 X |
| 4,354,858 | 10/1982 | Kumar et al. | 55/124 X |
| 4,357,151 | 11/1982 | Helfritch et al. | 55/6 |
| 4,481,017 | 1/1984 | Furlong | 55/12 |
| 4,776,864 | 10/1988 | Werner | 55/124 |
| 4,904,283 | 2/1990 | Hovis et al. | 55/131 |
| 5,059,219 | 10/1991 | Plaks et al. | 55/151 X |
| 5,069,691 | 12/1991 | Travis et al. | 55/126 |

*Primary Examiner*—Richard L. Chiesa
*Attorney, Agent, or Firm*—Lorusso & Loud

[57] ABSTRACT

An electrostatic precipitator includes a plurality of collector sections having parallel collection plates, defining gas flow lanes therebetween, and a bag filter section containing a plurality of parallel, elongated filter fabric bag elements. A plurality of corona discharge wires for charging solid particulates entrained in the gas flow entering the bag filter section are disposed parallel to and interspersed among the bag elements. Both the bag elements and the corona discharge wires within the bag filter section depend from a common plate member. Gas flow is from the outside of the bag elements to the inside and out through apertures in the supporting plate.

10 Claims, 3 Drawing Sheets

ENHANCEMENT OF ELECTROSTATIC PRECIPITATION WITH ELECTROSTATICALLY AUGMENTED FABRIC FILTRATION

FIELD OF THE INVENTION

This invention relates to electrostatic precipitators (hereinafter "ESPs") and, more specifically, to apparatus for reducing particulate emissions, i.e. penetration, to a lower level than heretofore possible with an ESP of comparable size. Sorbent injection technology and switching to lower sulfur fuels are being widely adopted for acid rain mitigation, while many municipal waste incinerators are slated for retrofit with spray dryers and dry sorbent injection. Both fuel switching and sorbent injection place a burden on the ESP by adding to the resistivity of dust, i.e. resistance to electrostatic charging, while sorbent injection also significantly adds to the amount of entrained dust to be collected. Hence a significant effort is required by the owner to upgrade the ESP so that compliance with particulate emission standards is maintained.

Further, air toxics legislation in the revised Clean Air Act of 1990 places liability on emissions of trace metals which tend to concentrate in the very fine particle fraction of dust entering ESPs. It is anticipated that many ESPs may require replacement or upgrading for air toxics control.

The greatest utility and the general field of application of this invention is in connection with sorbent injection used for acid rain mitigation. The problem addressed by the present invention results from increased inlet concentrations of particulates into the ESP due to sorbent injection into the waste gas. There is an absolute requirement that compliance with particulate regulations be maintained on power plants that have acid rain mitigation control systems. Because existing ESP's represent very large capital investments, there exists a great need for a capability for retrofitting existing ESP systems to allow plants utilizing these systems to meet, simultaneously, the new acid rain standards and standards for particulate emissions.

THE PRIOR ART

Norman Plaks, a coinventor here, is also a coinventor of the invention described and claimed in U.S. Pat. No. 4,904,283, entitled "ENHANCED FABRIC FILTRATION THROUGH CONTROLLED ELECTROSTATICALLY AUGMENTED DUST DEPOSITION." U.S. Pat. No. 4,904,283 discloses an inside-to-outside fabric bag filter wherein grounded electrodes are attached to the inside of the filter element or as wires woven therethrough, with a corona discharge wire mounted centrally within the bag filter element.

Penney in U.S. Pat. No. 3,910,779 discloses several embodiments of a particulate removal apparatus combining, in series, a charging section and a filter section. In the filter section, in one embodiment, cylindrical filter elements are supported by grounded metal support structures and are surrounded by high voltage plates. In another embodiment tubular high voltage plates are disposed inside the filter elements.

Helfritch et al in U.S. Pat. No. 4,357,151 disclose a cartridge type dust collector with corona discharge electrodes arranged around the periphery of the array of filter cartridges. Each filter cartridge is individually surrounded by a grounded, perforated shell and, accordingly, the electrical field extends between the corona electrodes and the grounded shells (primarily the shells around the periphery) and not across the filter element itself.

Reed et al in U.S. Pat. No. 3,915,676 also disclose an inside-to-outside tubular fabric filter element with a centrally disposed corona discharge electrode.

Linoya et al in U.S. Pat. No. 3,945,813 disclose a dust collector with ionizing electrodes disposed upstream of a filter screen. A row of dust-repulsing bar electrodes is disposed closely adjacent to and coextensive with the filter screen.

Postma et al in U.S. Pat. No. 4,029,482 also disclose the electrostatic charging of dust particulates upstream of a filter element.

Witte in U.S. Pat. No. 1,407,811 disclosed a track-mounted, grounded screen filter box downstream of an ESP.

None of these prior art electrostatically enhanced fabric filters is readily adaptable for retrofitting existing, conventional electroprecipitators. One problem posed by such retrofitting is lack of available space, i.e. ideally any addon filter system should lend itself to containment within one section of the conventional ESP. However, a larger problem resides in the fact that fabric filters produce a large pressure drop which, if introduced into an ESP system would likely require expensive replacement of a downstream fan with a larger capacity fan. Another problem with retrofitting conventional ESP's is the potential for any add-on disrupting the flow velocity distribution through the ESP.

SUMMARY OF THE INVENTION

Accordingly, it is an object of the present invention to provide a system for retrofitting existing ESP's to compensate for added particulate loading, increased difficulty of dust collection and/or for need to increase collection efficiency of finer, more toxic dust particles.

It is another object of the present system to provide such retrofitting in the form of an add-on modification occupying one section of a standard, multiple stage ESP.

Yet another object of the present invention is to provide such an add-on modification which does not significantly increase the pressure drop across the overall system.

Still another object of the present invention is to provide such an add-on modification for a conventional ESP which does not disrupt the flow velocity distribution within the ESP or otherwise impair its efficiency.

Another object of the present invention is to provide such an add-on modification for use in new installations where high capture efficiency is required and space for equipment is very limited.

These and other objects of the present invention are met by substitution of a fabric filtration bag unit, of a specific type and design, for the last field of a conventional ESP. Ideally, the fabric filtration unit is contained in the same housing as the ESP sections.

Accordingly, the present invention provides an electrostatic precipitator having a plurality of sections arranged in series in an elongated housing with a gas inlet at one end and an outlet at the opposite end. A plurality of these sections are conventional ESP collector sections, each containing a plurality of parallel collection plates which are evenly spaced to define a plurality of gas flow lanes therebetween. Corona discharge electrodes are arranged in each gas flow lane, upstream of the plates, between the plates or both.

Immediately downstream and contiguous with the last collector section is a bag filter section. In other words, the bag filter section is located between the plural collector sections and the gas outlet. The gas filter section is formed by an apertured plate from which the tubular fabric bags and corona discharge wires are suspended, thereby oriented in a direction transverse to the path of the gas flow entering the bag filter section. Each filter bag element is supported by a frame member which is conductive and grounded, with the ground running through the apertured plate. The corona discharge wires are dispersed among the bag filter elements and, preferably, each corona discharge wire is centered between four bag elements. The corona discharge wires or electrodes serve two functions, i.e. to impart a charge to the particulates carried by the incoming gas stream and to establish an electrical field running through the filter fabric to the grounded support frame.

An open end of each bag surrounds and seals with one aperture of the support plate. In this manner, the gas entering the filter section flows into the bags and out through the center of the bags and through the aperture in the support plate, i.e. outside-to-inside bag filtration. The apertured support plate covers a gas header through which the filtered gas exits.

The fabric filter section and each of the ESP sections is provided with a bottom hopper or other device for collecting particulates which are periodically dislodged from the collector plates and from the bag filter elements. The particulates are periodically dislodged from the collector plates in a conventional manner, e.g. by hammers, as is well known in the art. Likewise, particulates are periodically dislodged from the fabric filter elements in a conventional manner, e.g. by pulse cleaning with back flow from the header out through the filter elements.

The apparatus of the present invention, by charging the incoming solid particulates and by establishing an electrical field between the corona wires and the grounded fabric support cages, forces the charged particles to deviate from the moving gas streamlines and to be attracted by electrostatic precipitation. The resulting dust mass distribution is skewed toward the bags on the upstream side of the array leaving the bags on the opposite site of the array relatively clean for gas passage. It has been surprisingly found that the electrical enhancement of the fabric filtration provides for a system with a far less pressure drop than that of a bag filtration unit alone. In the system of the present invention, pressure drop across the bag filter section remains relatively constant at least until the innermost bag elements become fouled with particles. Surprisingly, it has been found that particulate build up occurs preferentially at the peripheral bags and then gradually inward, with the innermost, unfouled bags dictating the amount of pressure drop. In contradistinction, in a similar bag filtration unit without the electrostatic enhancement, particulate build up would be relatively uniform with a consequent uniformly increasing pressure drop. As noted by Penney in U.S. Pat. No. 3,910,779, electrostatic enhancement tends to produce a more porous deposit of the collected particulates on the filter surface and this porosity somewhat reduces the pressure drop across the filter element. However, the reduction of pressure drop due to the porosity of the deposit is considered to be of secondary importance to the above-noted phenomenon whereby the particulate build up occurs preferentially on the peripheral bags and preferentially at certain locations on those peripheral bags, with the innermost bag maintaining a relatively low pressure drop.

The invention enables the reduction of air toxic emissions in systems currently using an ESP. Addition of this invention by retrofit to an existing ESP will decrease the penetration of fine particles which contain the majority of the toxic materials in the emissions. Charged fine particles tend to follow electric field lines, which terminate upon the filter medium, rather than the gas streamlines that flow through open paths through the material.

The invention is especially applicable when retrofitting a sorbent injection system to an existing plant having an ESP and is one of the few "low cost" options available. The invention could also be applied to new installations. A second important utility and general field of application is for retrofit to processes such as municipal waste incineration. Existing municipal waste incineration units may soon be subjected to more stringent control than can be achieved by the currently installed ESP. Coming regulations are likely to require sorbent injection and cooling of the gas stream. The cooling of the gas stream will cause condensation of toxics, such as the dioxins and mercury, which can in turn be captured by the fabric filter.

DESCRIPTION OF THE PREFERRED EMBODIMENTS

Figure 1:
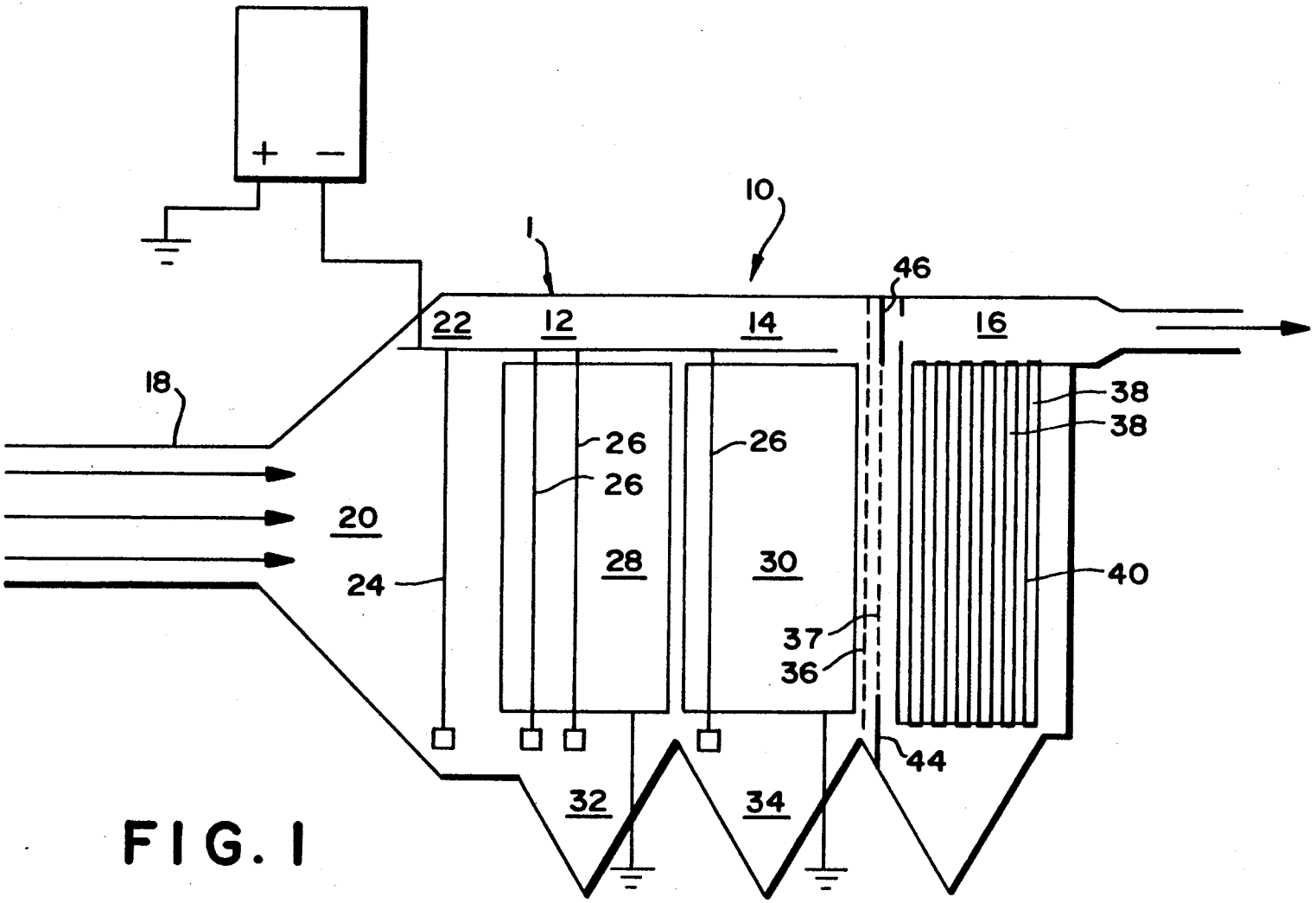
FIG. 1 is a schematic cross-sectional view of the apparatus of the present invention.

The fabric filtration bags that are substituted for ESP sections must be able to handle the gas volume without excessive pressure loss, fabric wear or mechanical instability. Typical ESPs, to which this invention would be applied, have two to four sections, each having specific collection area (SCA) of 75 square feet per 1000 cubic feet per minute gas flow, for overall SCA's of 150 to 300. For extreme situations where the dust is very toxic or highly resistive, larger ESPs, up to 600 SCA, may require retrofit.

Computer modeling results indicate that substantial improvement of ESP performance is realized if the final section is replaced with electrostatic filtration, although replacement of more than one section may be preferred where retrofit of bags is difficult due to unusual geometries within the ESP. For a typical four section ESP having collector-to-collection plate spacing of 9 inches and total plate area of 75,000 $ft^2$ per section, the equivalent volume of ESP field will allow replacement by fabric filter bags, 6" dia. with 2.5" spacing, totalling 80,900 $ft^2$ filter surface or a gas-to-cloth ratio of 16.0. If smaller, 4" dia. bags are used with 2" spacing, 111,500 $ft^2$ of filter surface may be installed at a gas-to-cloth ratio of 11.6. The 4" diameter bags, which have a larger filter area, operate at a lower gas-to-cloth ratio than do the 6" bags. However, the larger number of small diameter bags would very likely be more costly.

Replacement of two sections would obviously lower the gas-to-cloth ratio to between 5.8 and 8.0, but would not be economically warranted in many cases. High gas-to-cloth ratios generally mandate pulse jet cleaned fabric bags, in which the gas flows from the outside of the bag to the inside. The filtered particulate matter is therefore collected on the outside of the bag.

Conventional pulse jet cleaned filter bags can operate at gas-to-cloth ratios of up to 6:1 or more. The limitation is the pressure drop across the fabric filter bag as the collected dust layer is built up. From time-to-time a pulse or jet of air is directed down into the bag from the top to dislodge the collected dust layer from the outside of the bags. In the type of operation and application of this invention the particulate matter that will be reaching the fabric filtration bags will predominantly contain fine fractions. Much of the coarser particulate matter will have been removed from the gas stream by the ESP sections prior to its reaching the bags. The collection of fine particulate matter fractions will generally result in a higher resistance to flow across the filter medium than will the more normal particulate size distributions, from which the fine particulate matter has not been removed prior to filtration and which contain larger quantities of coarser particles. The system must therefore possess the capability to operate stably at high gas-to-cloth ratios without introducing excessively high pressure drops. The pulse jet fabric filtration technology is well known and is currently practiced by workers in the industry.

This invention allows stable operation at higher gas-to-cloth ratios than would be permitted by conventional outside-to-inside flow filtration. Unstable operation occurs when the pressure drop across the fabric and dust cake rises more rapidly than it can be relieved by the pulse jet cleaning mechanism. By simultaneously charging and electrostatically collecting the particles the resulting non-uniform deposit, and its accompanying reduced pressure drop, allows stable operation at increased gas-to-cloth ratios.

The complete system of the invention is shown in FIG. 1. The ESP is enclosed in a housing 10 which provides the structural support for the electrostatic collector sections 12 and 14 and for the filter bag section 16. The housing 10 also provides for gas flow containment and direction for the particulate laden gas entering the device through the duct or inlet 18. The transition section 20 provides a gas flow having a uniform velocity distribution to the ESP fields or sections 12 and 14. While the ESP will conventionally have five or more sections, for sake of simplicity only two such sections 12 and 14 are depicted in FIG. 1. Each ESP section may in turn be divided into a charging section and a collector section as described in U.S. Pat. No. 5,059,219 issued to Norman Plaks et al Oct. 22, 1991 and entitled "ELECTROPRECIPITATOR WITH ALTERNATING CHARGING AND SHORT COLLECTOR SECTIONS," the teachings of which are incorporated by reference. In the ESP described in U.S. Pat. No. 5,059,219 corona discharge electrodes are provided both between the collector plates and as a linear transverse array in each charging section. In the alternative, a separate precharging section may be provided upstream of plural collector sections, as illustrated by precharging section 22 in FIG. 1. Precharging section 22 consists of a linear array of corona discharge electrodes 24 arranged traverse to the gas flow and alternating with grounded pipes (not shown) as described in U.S. Pat. No. 5,059,219. In addition, a linear array of corona discharge electrodes is disposed between each pair of adjacent electrode plates 28 and plates 30, again as described in U.S. Pat. No. 5,059,219. A few of these latter corona discharge wires are depicted in FIG. 1 at 26 for purposes of illustration. Thus, each of the ESP sections in the present invention can be either a single-stage ESP section in which both particle charging and collection occur simultaneously, or a two-stage ESP section in which a precharger is used to separate the charging and collection functions.

The particulate matter that is collected is mechanically removed from the ESP plates 28, 30 from whence it falls into the hoppers 32 and 34. The ESP sections 12 and 14 are energized with high voltage DC power from transformer/rectifier units (not shown).

After passing through the ESP sections the gas, with the majority of the particulate matter removed, passes through a series of diffusion plates 36, 37 to help retain good flow velocity distribution for the gas exiting the ESP sections. The use of diffusion screens for improvement of velocity distributions in ESPs is well known to workers in the art, and is widely practiced. See, for example, H. White, *Industrial Electrostatic Precipitation*, Addison-Wesley, Reading, Pa., 1963, Pgs, 265–272. The diffusion screens are generally steel plates perforated with holes 1 to 2 in. in diameter and the holes are evenly distributed on the plates so that the open area is between 50 to 65%. Diffusion screens in series should have a minimum spacing of 5 to 10 hole diameters and should be oriented so that they are perpendicular to the flow.

Baffles 44, 46 induce a slight pressure drop entering the filter section 16 so as to maintain good uniform velocity distribution through the ESP sections. The baffle plates 44 and 46 also serve to prevent gas flow into the hopper area from reentraining particulate matter that is dislodged from the bags by the cleaning process. This is especially important because the longest practical length for pulse jet bags will be somewhat shorter than the collector plate lengths of many ESP field sections.

Figure 2:
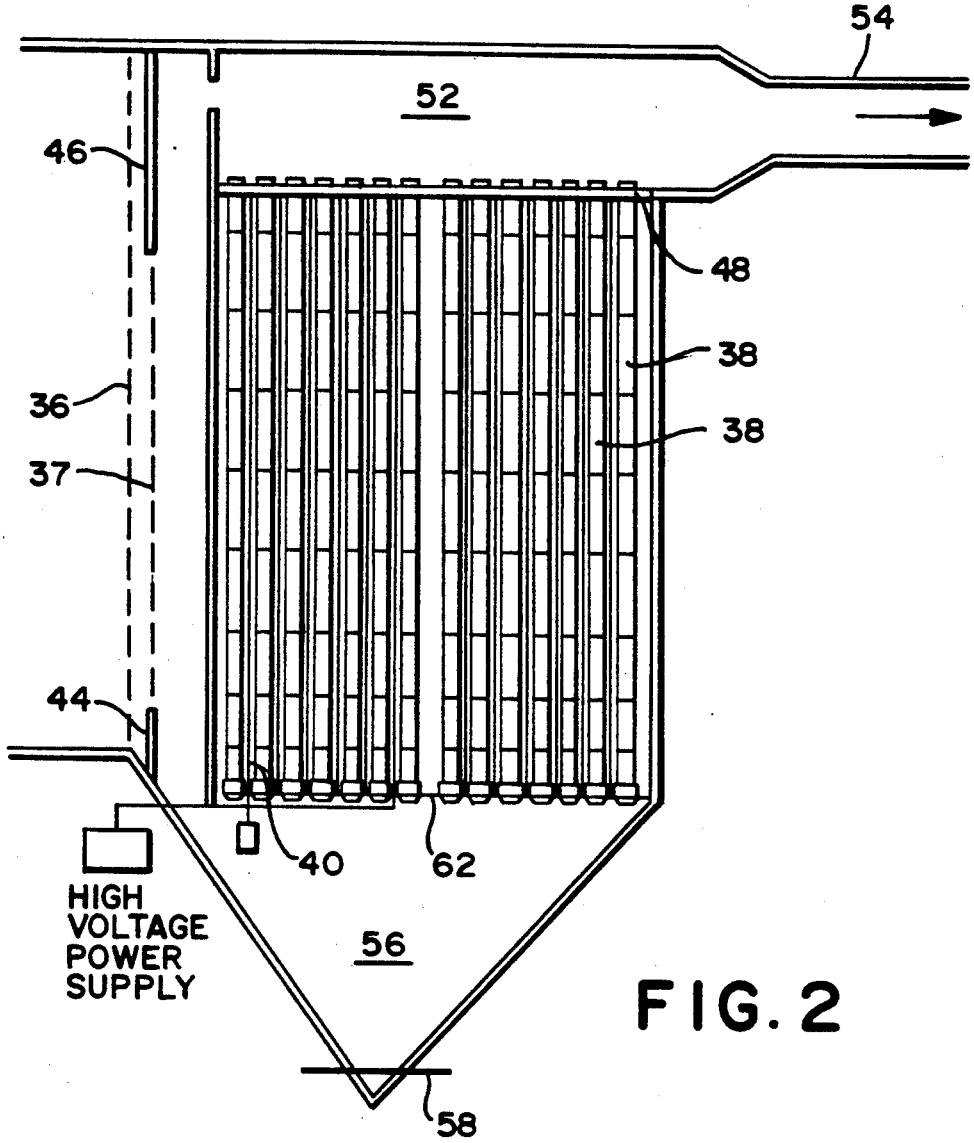
FIG. 2 is an enlarged partial view, in cross-section, showing the last section of the apparatus of FIG. 1.
Figure 3:
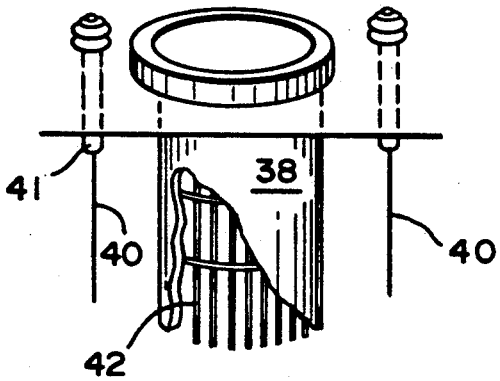
FIG. 3 is a partial perspective view showing detail of the filter section depicted in FIG. 2.

The gas exiting the diffusion plates 36, 37 enters the pulse jet fabric filtration section 16 in which the bags 38 are mounted vertically and perpendicular to the flow. As seen in FIG. 2, the bags 38 have corona discharge electrodes 40 centrally located within each group of bags to electrically charge the particles entering the filtration region. A wire frame 42 (FIG. 3) which is conventionally used to support pulse jet baghouses is grounded to establish the electric field from the corona discharge to itself. The charged particles follow the electric field lines causing them to terminate upon the fabric surface more rapidly than if they were only following the gas flow.

For proper operation of this invention it is necessary to have suitable electrical conditions (voltage and current) to charge the particles and cause them to deposit in the nonuniform manner which allows attainment of high gas-to-cloth ratios. The high voltage applied between the corona discharge electrodes and the grounded support cages located within the bags will range between 25 to 50 kilovolts. The actual value will be dependent upon the diameter and surface characteristics of the corona discharge electrode and the spacing between the electrodes and the bags. As is well known and practiced by workers in electrostatic precipitation the current will be dependent upon the particulate matter resistivity and the concentration and size distribution of the particles in the gas stream. Expected current values will range from 2E-6 to 1E-4 amperes per foot of corona discharge electrode. Typical values for low resistivity particulate matter with ⅛" diameter corona discharge electrodes for 6" diameter bags with 2½" spacing would be 40 kilovolts and 7E-5 amperes per foot of corona electrode; the respective voltage and currents for 4" diameter bags having a 2" spacing would be 33 kilovolts and 5E-6 amperes per foot of corona discharge electrode. For high resistivity particulate matter, the presence of back corona will require both a somewhat lower voltage and current. The actual voltage that is applied, as is very well known and practiced by workers in electrostatic precipitation, should be set at the highest value so that it is limited by sparking for low resistivity particulate matter, and back corona for high resistivity particulate matter. The higher the voltage and current, the greater is the electrostatic precipitation effect and the better is the performance of the invention. Operation within these ranges and under the limiting conditions will allow adequate performance of this invention when used to replace the last section of an ESP. The higher voltage and current when operating with low resistivity particulate matter will provide somewhat better performance than the lower voltage and current when operating with high resistivity particulate matter. Techniques commonly used in electrostatic precipitation to lower resistivity, such as gas conditioning by injecting sulfur trioxide or moisture, could be beneficial by allowing higher voltages and currents when operating with very high resistivity particulate matter.

The grounded wire frames 42, the bags 38 and the corona discharge wires 40 all depend from an apertured plate 48 provided with a plurality of openings 50. At the lower surface of each opening 50 is a bag 38 with its open end sealed around opening 50 so that gas passing through bag 48 exits through an opening 50 into header space 53 and out through outlet 54.

Figure 5:
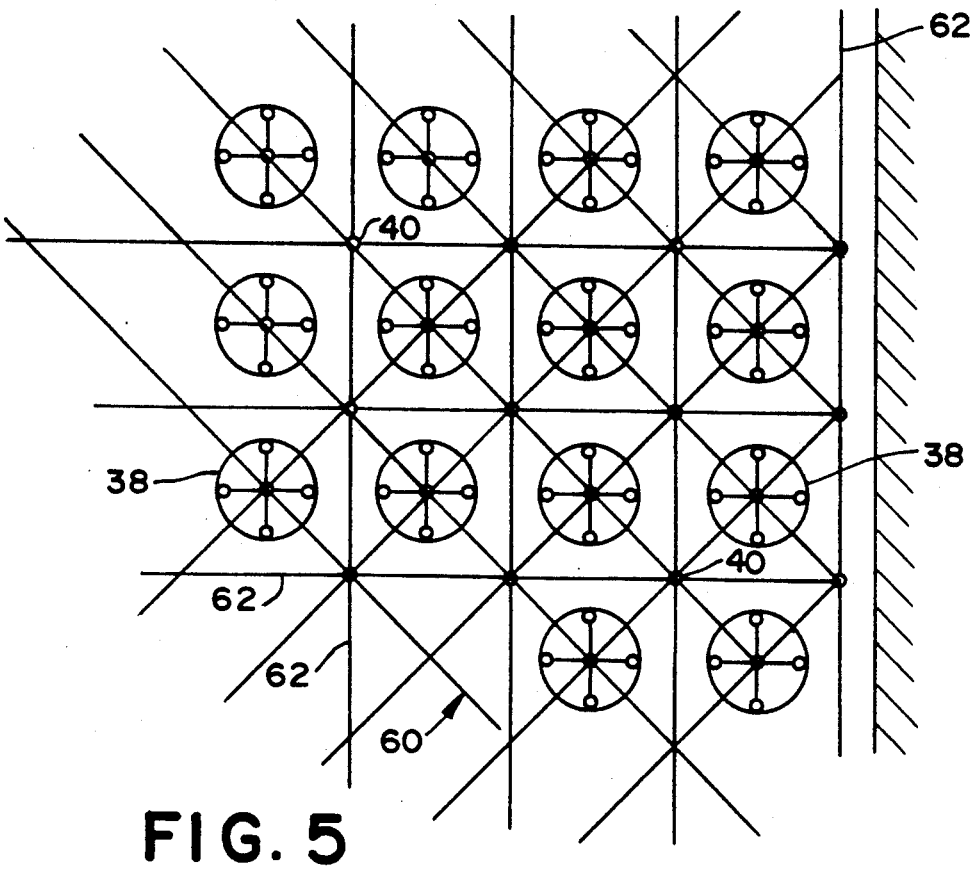
FIG. 5 is a plan view schematic of the grid structure secured to the bottoms of the filter bags.
Figure 6:
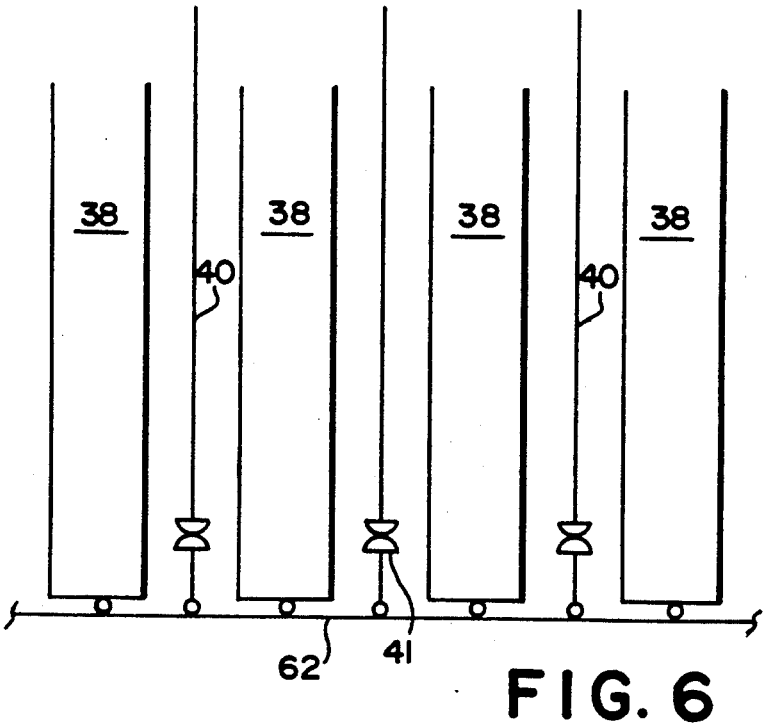
FIG. 6 is a side view of the structure shown in FIG. 5.

In a conventional pulse-jet cleaned outside-to-inside flow baghouse the bag bottoms are not anchored together and, consequently, there is movement of the bottoms relative to each other especially when the bags are cleaned by the high velocity gas pulses. However, in the present invention it is necessary to maintain a constant spatial relationship of the bag bottoms relative to each other. A preferred embodiment is a frame 60 made up of steel rods 62 as shown in FIGS. 5 and 6, that is fastened to the bottom of the cages 42 that are internal to each of the bags 38. The intersection of the diagonal rods 62 between each group of four bags are the anchor points for the corona electrodes 40 and their insulators 41.

Particulates collected on the surfaces of bags 38 are periodically removed by pulse jet cleaning, in the conventional manner, and collected in hopper 56 normally closed by a slide valve 58.

Figure 4:
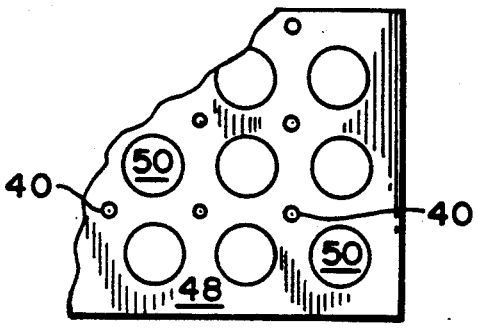
FIG. 4 is a plan view of an upper support plate such as included in the filter section of FIG. 2.

FIG. 4 shows that, in the filter section 16 each corona discharge electrode is centered on four bag elements 38. While FIG. 4 shows a three-by-three array of bags 38, for simplicity, it will be understood that FIG. 2 illustrates a fourteen-by-fourteen array of bags 38.

The present invention offers many advantages, for example the use of electrostatically augmented fabric filtration to increase the gas-to-cloth ratio of the pulse jet bags allows them to fit into the space occupied by the final field of an ESP, and still provide adequate gas handling capability. Conversely, the use of an ESP upstream of the electrostatically augmented fabric filtration bags to remove the bulk of the particulate matter from the gas stream thereby making it unnecessary to clean them as frequently, which extends their life. Further, electrostatic augmentation in accordance with the present invention decreases penetration of bag fabric by fine particles and decreases pressure losses, both of which allow longer fabric life and better long-term control of fine (and toxic) particles due to fewer rips and holes in the fabric.

It will be understood that various changes in the details, materials, steps and arrangement of parts which have been herein described and illustrated in order to explain the nature of the invention, may be made by those skilled in the art within the principle and scope of the invention as expressed in the appended claims.

We claim:

1. An electrostatic precipitator formed of a plurality of sections arranged in series in an elongated housing having a gas inlet at one end and a gas outlet at the other end defining a gas flow path for gas flow therebetween, said sections comprising:

a plurality of collector sections, each of said collector sections comprising a plurality of parallel collection plates, said collection plates being evenly spaced to define a plurality of gas flow lanes therebetween, and first particulate collection means for collecting electroprecipitated particles from the bottom of each of said collector sections;

a bag filter section located between said plurality of collector sections and said gas outlet, said bag filter section comprising:

an apertured plate defining the top of the interior of said bag filter section, said apertured plate having a plurality of openings;

a plurality of parallel, elongated filter fabric bag elements depending from said apertured plate and extending across and transverse to the path of gas flow entering said bag filter section, each of said bag elements covering one of said openings;

a plurality of grounded electrically-conductive support frames mounted on said apertured plate, each support frame being internal to and supporting one of said filter fabric bag elements;

a plurality of corona discharge wires for charging solid particles entrained in gas flow, said corona discharge wires being suspended from said apertured plate and disposed parallel to and interspersed among said bag elements; and second particulate collection means for collecting separated particulates, dislodged from said bag elements, from the bottom of said bag filter section; and gas collecting means for collecting gas passing through bag elements and routing said collected gas to said gas outlet.

2. An electrostatic precipitator in accordance with claim 1 wherein at least a portion of said corona discharge wires are each centered between four said bag elements.

3. An electrostatic precipitator in accordance with claim 1 wherein each of said support frames is a metal cage.

4. An electrostatic precipitator in accordance with claim 1 further comprising a plurality of gas diffusion plates extending across said gas flow path and mounted between said collector sections and said bag filter section.

5. An electrostatic precipitator in accordance with claim 1 further comprising frame means connected to each of said elongated fabric filter bag elements and each of said corona discharge wires for maintaining the spacial relationship between said elongated fabric filter bag elements and said corona discharge wires.

6. An electrostatic precipitator formed of a plurality of sections arranged in series in an elongated housing having a gas inlet at one end and a gas outlet at the other end defining a gas flow path for gas flow therebetween, said sections comprising:

a plurality of collector sections, each of said collector sections comprising a plurality of collection plates, said collection plates being spaced to define a plurality of gas flow lanes therebetween, and first particulate collection means for collecting electroprecipitated particles from the bottom of each of said collector sections;

a bag filter section located between said plurality of collector sections and said gas outlet, said bag filter section comprising:

an apertures plate defining the top of the interior of said bag filter section, said apertured plate having a plurality of openings;

a plurality of parallel, elongated filter fabric bag elements depending from said apertured plate and extending across and transverse to the path of gas flow entering said bag filter section, each of said bag elements covering one of said openings;

a plurality of grounded electrically-conductive support frames mounted on said apertured plate, each support frame being internal to and supporting one of said filter fabric bag elements;

a plurality of corona discharge wires for charging solid particles entrained in gas flow, said corona discharge wires being suspended from said apertured plate and disposed parallel to and interspersed among said bag elements; and second particulate collection means for collecting separated particulates, dislodged from said bag elements, from the bottom of said bag filter section; and gas collecting means for directing at least the majority of the gas flow through said bag elements and for collecting gas passing through said bag elements and routing said collected gas to said gas outlet.

7. An electrostatic precipitator in accordance with claim 6 wherein at least a portion of said corona discharge wires are each centered between four said bag elements.

8. An electrostatic precipitator in accordance with claim 6 wherein each of said support frames is a metal cage.

9. An electrostatic precipitator in accordance with claim 6 further comprising frame means connected to each of said elongated fabric filter bag elements and each of said corona discharge wires for maintaining the spacial relationship between said elongated fabric filter bag elements and said corona discharge wires.

10. An electrostatic precipitator in accordance with claim 6 wherein said gas collecting means directs substantially all of the gas flow through said bag elements.

* * * * *